US005713806A

United States Patent [19]

Teitgen et al.

[11] Patent Number: 5,713,806

[45] Date of Patent: Feb. 3, 1998

[54] BACKBOARD PAD

[75] Inventors: Rex A. Teitgen, Sandy; Gordon R. Allred, Salt Lake City, both of Utah

[73] Assignee: Sport Court, Inc., Salt Lake City, Utah

[21] Appl. No.: 780,601

[22] Filed: Jan. 10, 1997

[51] Int. Cl.[6] ..... A63B 63/08

[52] U.S. Cl. ..... 473/481

[58] Field of Search ..... 473/481, DIG. 100, 473/DIG. 101

[56] References Cited

U.S. PATENT DOCUMENTS

| | | | |
|---|---|---|---|
| 4,285,518 | 8/1981 | Pearo | 473/481 |
| 4,424,968 | 1/1984 | Smith | 473/481 |
| 4,650,188 | 3/1987 | Schroeder | 473/481 |

OTHER PUBLICATIONS

Basketball Products International (BPI) 1995—96 Product Catalog.

Bison—After the Dust Settles 1995–1996 Catalog.

Gared Sports, Inc. 1994–1995 Catalog.

*Primary Examiner*—William H. Grieb

*Attorney, Agent, or Firm*—Thorpe, North & Western

[57] ABSTRACT

A basketball backboard pad for protecting basketball players from the sharp edge and corners of a backboard while maintaining the vibration and rebound characteristics of the backboard has a resilient skin and a hollow interior. The backboard pad preferably has a horizontal member and a vertical member integrally attached to and generally perpendicular to the horizontal member. A groove is formed in the members for mating with the edge of the backboard. The skin forms an inner surface that faces towards the edge of the backboard and connects to the backboard. A radius is formed between the inner surface and the rest of the surface for preventing players from handing from the pad and damaging it.

17 Claims, 6 Drawing Sheets

BACKBOARD PAD

BACKGROUND OF THE INVENTION

1. Field of the Invention

The present invention relates to a backboard pad for protecting basketball players against the lower edge and corners of a basketball backboard. More particularly, the present invention relates to a backboard pad having a resilient skin and a hollow interior to cover the edge and corners of the backboard while substantially maintaining the vibration and rebound characteristics of the backboard.

2. Prior Art

The game of basketball is a popular sport played by many people from young children to professional athletes. The game is played by attempting to shoot a ball through a hoop attached to an elevated backboard, known as a goal. Although the object of the game is to score the most points by getting the ball through the hoop, an added element of style, known as "slam dunking" or "jamming", has become popular. To slam dunk or jam, a player leaps into the air with sufficient height to hold the ball above the hoop and force it through, often to the great delight of spectators and other players. This maneuver is often performed by professional players and is perhaps more often attempted by admiring youth and amateurs in an effort to mimic their favorite professional player. Because the hoop and backboard are positioned at a vertical height unreachable by many people, special goals have been developed that adjust the vertical height of the backboard so that youth and the vertically challenged may not only play the sport at a more, comfortable level, but slam dunk or jam like professional players. The players not only leap to slam dunk and jam, but to rebound, or retrieve the ball, when another player fails to get the ball through the hoop. The result is that professional and other tall players often hit the backboard with their hands, arms, or even their heads. Because backboards are typically made of hard material like wood, metal, or glass with an aluminum frame, players are often injured when they strike the backboard. This situation is aggravated by the vertically adjustable goals that introduce the potential for injury to much shorter players such as children.

In an effort to reduce injury, backboard pads have been developed to guard the lower edge and corners of the backboard. The guards typically cover the lower edge, lower corners, and the lower sides of the backboard. The basic guards are made of a closed cell rubber such as urethane foam that are either bolted, screwed, glued, or taped onto the edge of the backboard. Many pads have an integral skin to protect the foam. Others have a cotton sock that fits over the pad to protect the foam and provide color variations. Others have a steel track covered with the foam and formed in a channel to mate with the edge of the backboard. Still others have metal inserts corresponding to bolt or screw locations.

One of the problems with this type of pad is the cost and difficulty of production. It is a difficult and expensive process to either dip the foam to coat it with the skin or to mold the pad with the skin. The addition of steel inserts further complicates the process and adds cost. Because of the high cost of pads, they are often not installed on private, residential goals, which is often where they are needed the most.

Another problem with this type of pad is that it is unsuited for outdoor use. The urethane skin or cotton sock deteriorates rapidly when exposed to moisture, temperature changes and extremes, and UV rays. The vertically adjustable goals are typically installed at private dwellings, and thus outdoors. Therefore, it is important that the pad be able to withstand the elements.

An addition problem, and perhaps the most important, is the effect of the pad on the vibration and rebound characteristics of the backboard. When playing basketball, the ball strikes the hoop or the backboard causing the hoop and backboard to vibrate. The vibrating motion of the goal has an effect on the motion of the hoop and therefore, an effect on whether the ball either enters the hoop or is deflected away from the hoop. Furthermore, after the ball strikes the hoop or backboard, it rebounds, or is deflected, off the hoop or backboard in a particular manner. Although in theory the hoop and backboard are rigid, the reality is that the hoop and backboard have a certain amount of play or motion that affects the way the ball is rebounded.

Traditional pads are made of foam. Because foam tends to absorb vibration, these pads distort the vibrational characteristic of the goal. Furthermore, traditional pads are made of a heavy, solid foam attached to the lower half of the backboard. Because a heavy weight is attached to only one half of the goal, the weight of the pad is unevenly distributed on the goal and the play or motion in the goal is altered. The overall affect of these pads is to deaden the response of the goal.

The change in the vibration and rebound characteristics of the goal can have a detrimental effect on a player's game. The player learns to shoot the ball in a particular way, such as off a certain part of the backboard, in order to finesse it through the hoop. The player also learns to position and jump in a particular way in order to rebound the ball due to the way it strikes the hoop or backboard. A player comes to expect certain responses from the goal. The player that practices on a goal without a pad and then plays on a goal with a pad may not perform as well due to the change in the vibrational and rebound characteristics of the goal.

Therefore, it would be advantageous to develop a backboard pad capable of protecting players yet inexpensive and easy to produce. It would also be advantageous to develop a backboard pad capable of withstanding the elements and thus capable of installation on outdoor backboards. In addition, it would be advantageous to develop a backboard pad capable of protecting players while substantially maintaining the vibration and rebound characteristics of the hoop and backboard.

OBJECTS AND SUMMARY OF THE INVENTION

It is an object of the present invention to provide a backboard pad for protecting players from the sharp edge and corners of a backboard.

It is another object of the present invention to provide a backboard pad that is inexpensive and easy to produce.

It is yet another object of the present invention to provide a backboard pad capable of withstanding the elements and thus capable of installation on outdoor goals.

It is a further object of the present invention to provide a backboard pad that substantially maintains the vibration and rebound characteristics of the goal.

These and other objects and advantages of the present invention are realized in a backboard pad having a resilient skin and a hollow interior. The pad has a horizontal member and a vertical member integrally attached to the horizontal member and generally perpendicular to the horizontal member. A groove is formed in the members for mating with the edge of the backboard. The skin forms an inner surface facing the edge of the backboard for mounting the pad to the backboard. A radius is formed between the inner surface and the remaining surface to prevent players from hanging from the pad and damaging it or ripping it from the backboard. Because the pad uses no foam it does not absorb vibration caused by the basketball striking the goal and thus maintains the vibration characteristic of the backboard. Because the pad is hollow, it is substantially lighter than the foam core pads and thus maintains the balance and rebound characteristic of the backboard.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
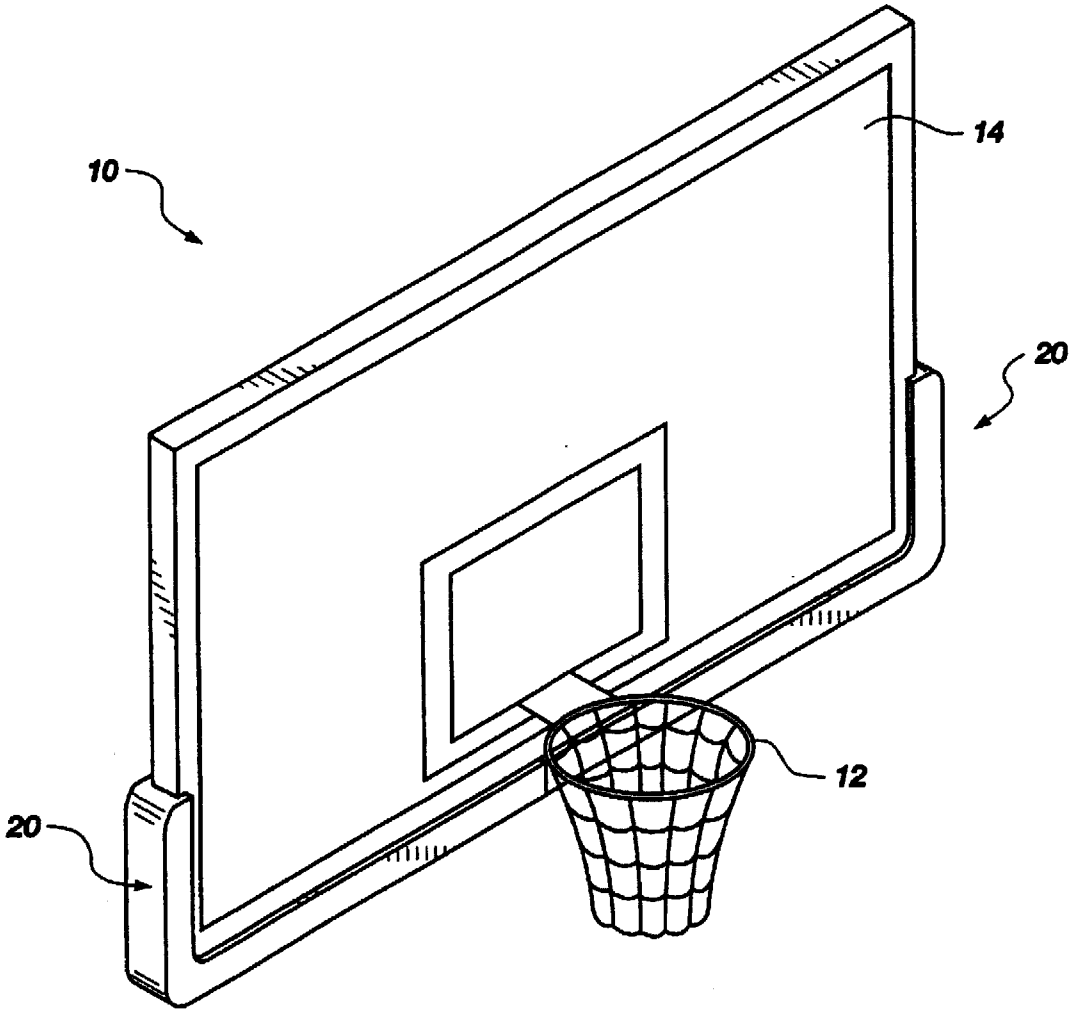
FIG. 1 is a perspective view of a basketball goal incorporating a preferred embodiment of the backboard pad of the present invention.

As illustrated in FIG. 1, a basketball goal 10 is shown with a backboard pad 20 of the present invention. The goal 10 has a hoop 12 attached to a backboard 14. The backboard 14 is typically manufactured in various standard widths, such as 44, 48, 54, 60 and 72 inches. Basketball goals 10 are located indoors and outdoors. Indoor goals are typically used by institutions such as schools and gyms. Outdoor goals are typically used by both institutions and private, residential dwellings. The goal 10 is elevated above the playing surface. Although the official height of the goal is ten feet, adjustable goals may be positioned significantly lower. A basketball (not shown) is shot by players (not shown) at the hoop 12 and backboard 14 in an attempt to get the basketball through the hoop 12. The players leap in an effort to get the ball through the hoop 12 or rebound the ball if a shot is missed. By leaping, the player's hands, arms, shoulders, and head may strike the sharp edge and corners of the backboard 14.

Figure 2:
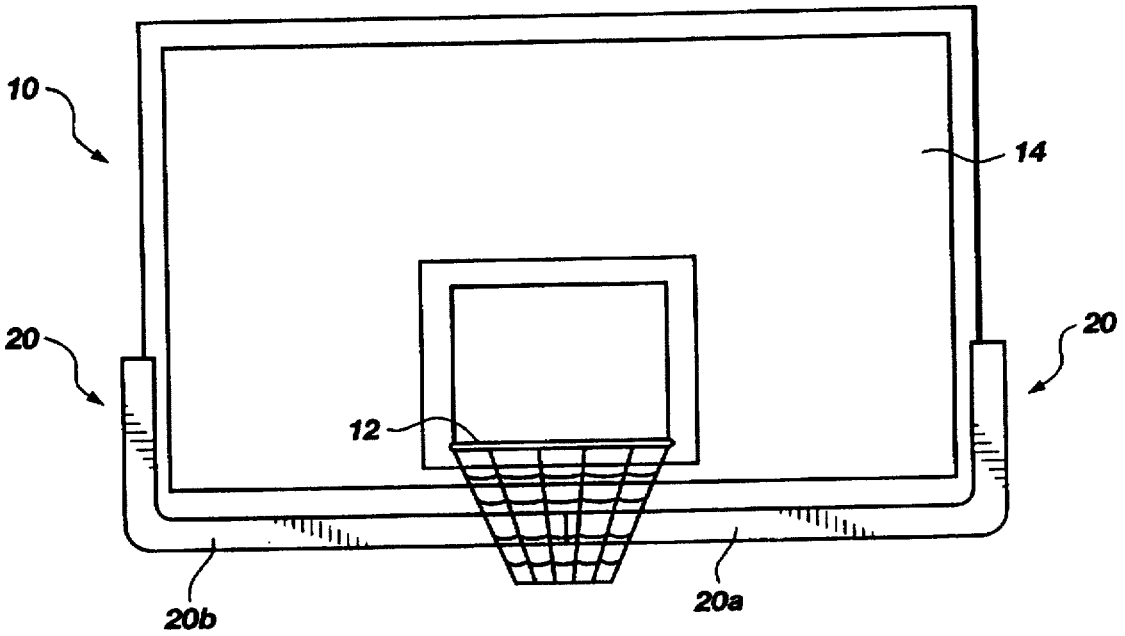
FIG. 2 is a front elevational view of a basketball goal incorporating a preferred embodiment of the backboard pad of the present invention.
Figure 3:
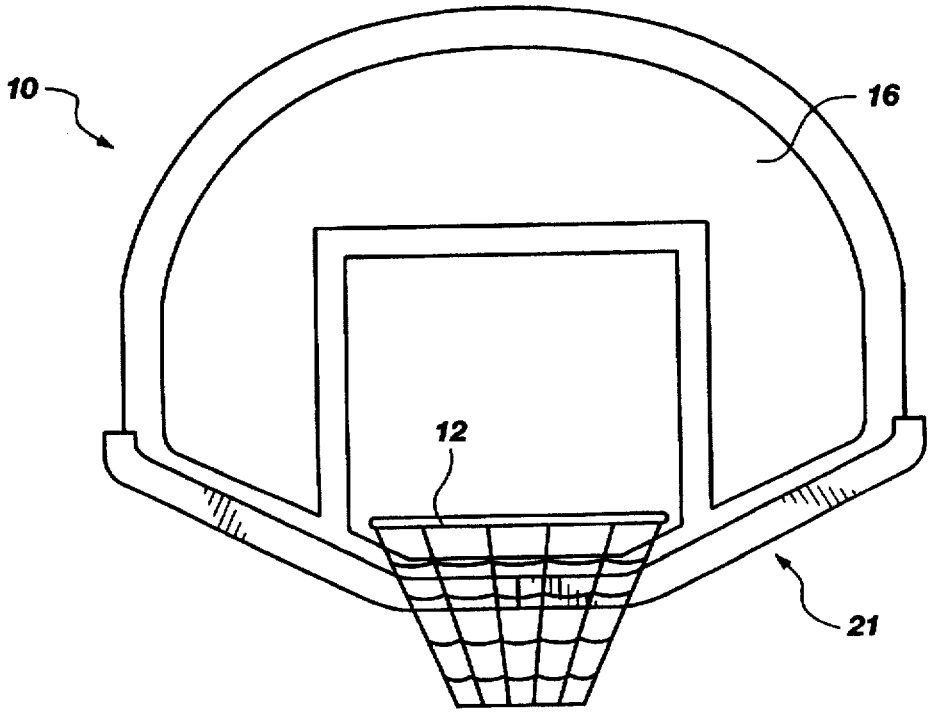
FIG. 3 is a front elevational view of a basketball goal incorporating an alternative embodiment of the backboard pad of the present invention.

Although particular reference is made to the preferred embodiment as incorporated on a rectangular backboard 14, as shown in FIGS. 1–2, the present invention may be adapted for use on a fan-shaped backboard 16, as shown in FIG. 3.

As illustrated in FIGS. 1–2, the backboard pad 20 of the present invention covers the sharp edge and corners of the backboard 14 to help prevent injury to players. In the preferred embodiment of the present invention, the backboard pad 20 is advantageously formed along its length as an L-shaped member. The lower edge and corners of the backboard 14 may be completely covered by using two backboard pads 20*a* and 20*b* as shown in FIG. 2. Alternatively, the backboard pad 20 may be formed as a single, U-shaped member. The L-shaped backboard pad 20, however is easier to manufacture and ship. In addition, the horizontal leg of the L-shaped backboard pad 20 may be advantageously manufactured with varying lengths corresponding to the various standard lengths of backboards 14.

For fan-shaped backboards 16, as shown in FIG. 3, the backboard pad 21 may similarly be formed by one or more separate pieces. In addition, the backboard pad 21 may be formed as a single elongated member that is bent to conform to the contours of the backboard 16.

Figure 4:
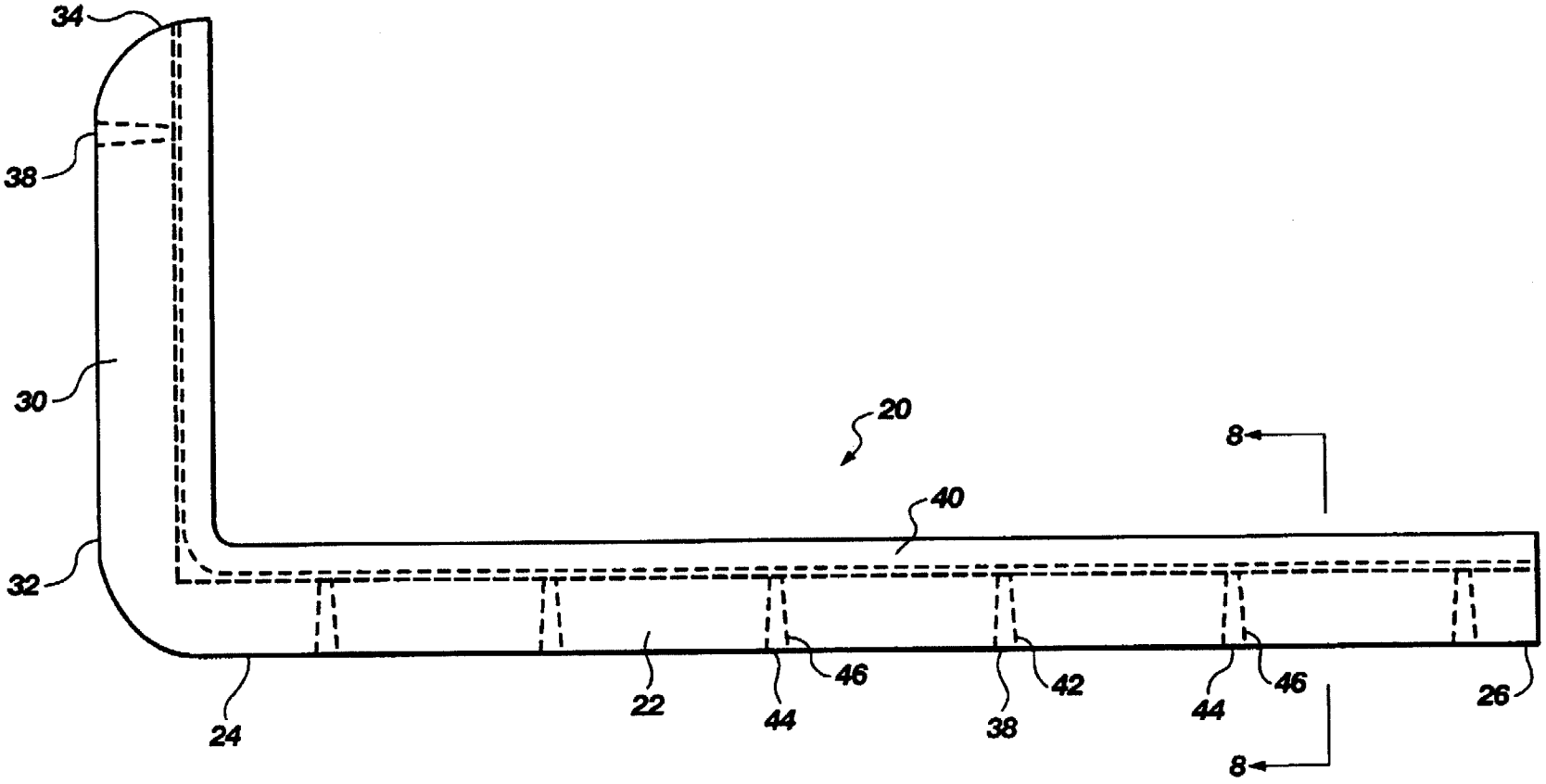
FIG. 4 is a front elevational view of a preferred embodiment of a backboard pad of the present invention.
Figure 5:
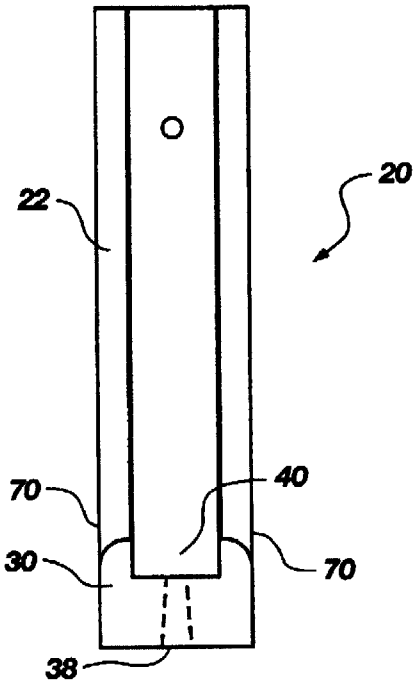
FIG. 5 is a side elevational view of a preferred embodiment of a backboard pad of the present invention.
Figure 6:
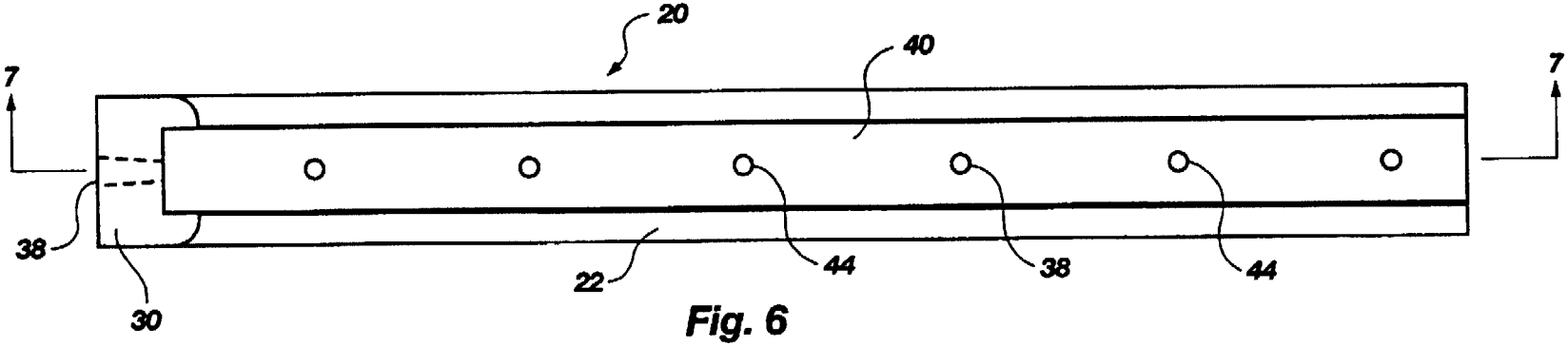
FIG. 6 is a top view of a preferred embodiment of a backboard pad of the present invention.

Referring to FIGS. 4–6, in the preferred embodiment the backboard pad 20 has a horizontal member 22 having a proximal end 24 and a distal end 26. The backboard pad 20 also has a vertical member 30 having a proximal end 32 and a distal end 34. The proximal end 32 of the vertical member 30 is preferably integrally connected to the proximal end 24 of the horizontal member 22. The vertical member 30 is generally perpendicular to the horizontal member 22.

The horizontal member 22 and vertical member 30 have mounting holes 38 strategically located for bolting or screwing the backboard pad 20 onto the backboard 14. The mounting holes 38 may have a wall 42 for aiding the alignment of screws or bolts during installation and for preventing the screws from falling off the screw driver and becoming lost in the pad 20. Alternatively, the backboard pad 20 may be attached the backboard 14 using adhesive or double sided tape.

Figure 10:
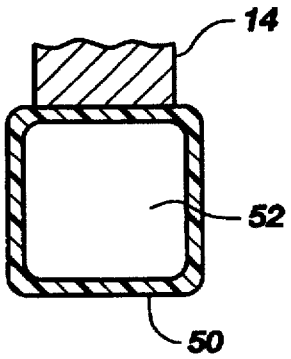
FIG. 10 is an elevational cross section view of an alternative embodiment of a backboard pad of the present invention.
Figure 11:
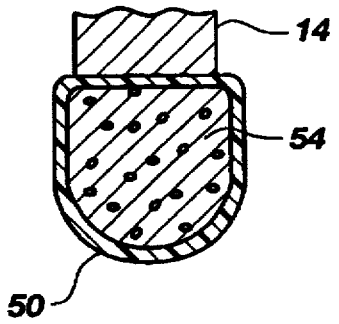
FIG. 11 is an elevational cross section view of an alternative embodiment of a backboard pad of the present invention.

A channel 40 is formed in the members 22 and 30. The channel 40 is sized to mate with the edge of the backboard 14. Preferably, the backboard pad 20 encompasses or surrounds the edge of the backboard 14 by having the edge of the backboard 14 nest in the channel 40 formed in the backboard pad 20. Alternatively, the backboard pad 20 may merely attach to the edge of the backboard 14, as shown in FIGS. 10–11.

Figure 7:
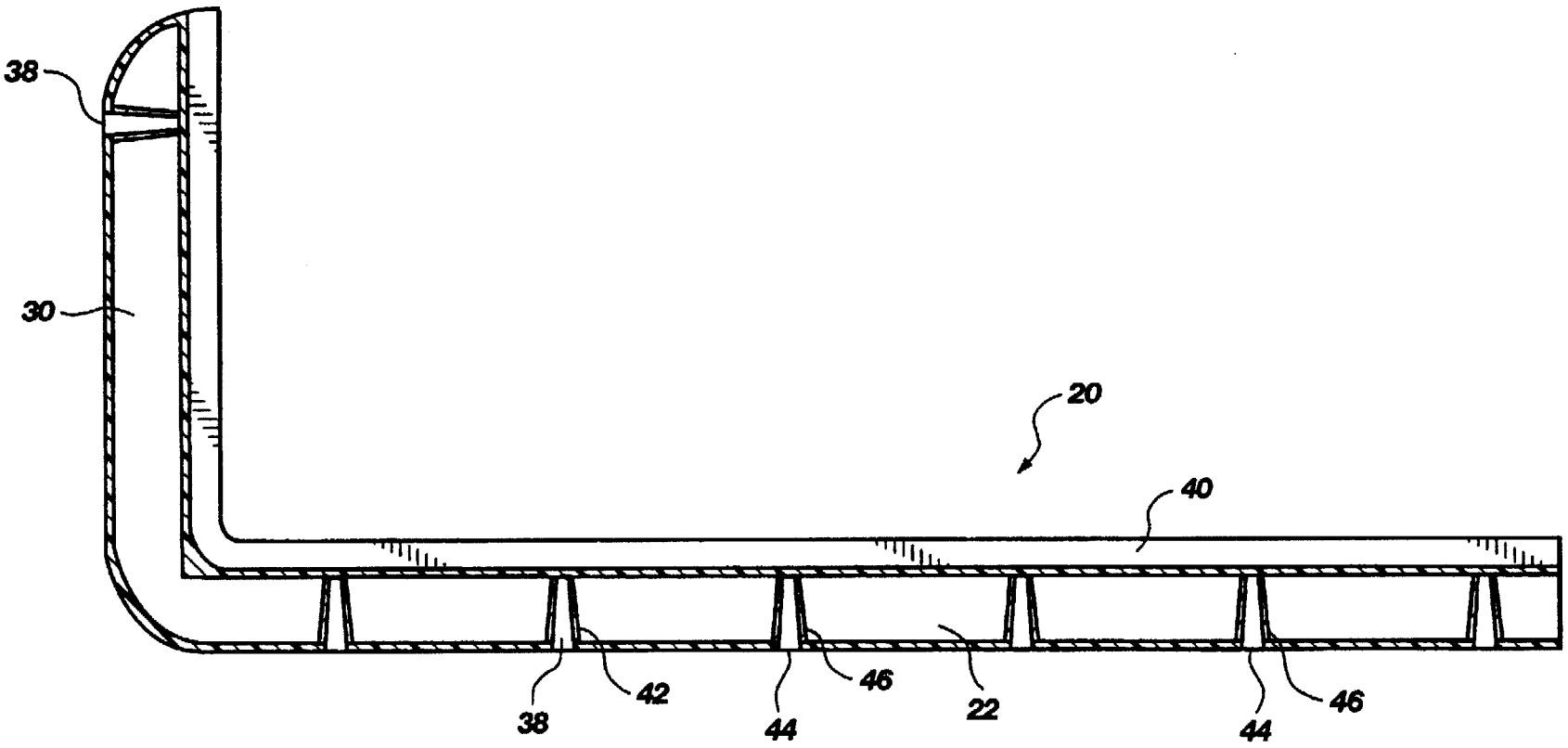
FIG. 7 is an elevational cross section view of a preferred embodiment of a backboard pad of the present invention taken along line 7—7 of FIG. 6.

As shown in FIGS. 4, 6, and 7, the backboard pad 20 may have through holes 44 for reinforcing the pad 20 or for draining any moisture that becomes trapped between the channel 40 and the backboard 14. The through holes 44 extend through the pad 20 and have a wall 46 for reinforcing the pad 20 or acting as a conduit for draining moisture from the channel 40. The mounting holes 38 may also have walls 42 for reinforcing the pad 20. In addition, surface holes (not shown) may be added at the bottom of the pad 20 and extending into the pad 20 for draining any moisture that enters the pad 20.

Figure 8:
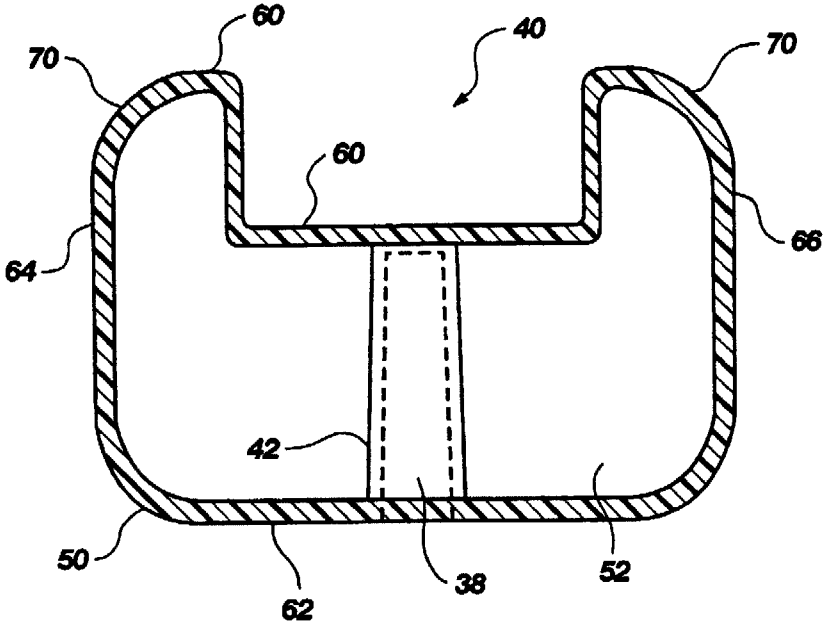
FIG. 8 is an elevational cross section view of a preferred embodiment of a backboard pad of the present invention taken along line 8—8 of FIG. 4.

As shown in FIG. 8, both the horizontal member 22 and the vertical member 30 are formed by a resilient skin 50 and have a hollow interior 52. Because of the hollow interior 52, the resilient skin 50 is able to deform or yield when a force, such as an impact, is applied to the members 22 and 30. The resilient nature of the skin 50, however, requires the force or impact to be significant. Therefore, the combined hollow interior 52 and resilient skin 50 advantageously act as a protective cushion without the need for a foam core.

Other pads that use foam tend to alter and distort the vibration characteristics of the backboard 14. The foam in these pads absorbs vibration caused by the basketball striking the hoop 12 or backboard 14. The vibration of the backboard 14 and hoop 12 can have an effect on whether the ball passes through the hoop 12 or is deflected. It is undesirable to have the particular vibration character of the backboard 14 altered by the addition of a vibration absorbing, foam pad.

In addition, other pads with a foam filled core tend to alter and distort the rebound characteristics of the backboard 14. These foam filled pads have significant weight that is added only to the lower half of the backboard 14. The significant weight of these pads is unevenly distributed on the lower half of the backboard 14. When a basketball strikes the backboard 14, the ball is deflected, or rebounded, off the backboard 14. The backboard 14 moves a small fraction which affects the manner in which the ball is rebounded. It is undesirable to have the rebound characteristics of the backboard 14 altered by the addition of a heavy, foam filled pad.

A player may have his game negatively affected when, after practicing on a particular goal and coming to expect certain responses from the goal, the response of the goal is altered by a heavy, vibration absorbing, foam filled pad. Because the backboard pad 20 advantageously creates a protective cushion with the hollow interior 52 and resilient skin 50, no heavy, vibration absorbing foam, such as a closed cell rubber, is required.

Furthermore, the backboard pad 20 advantageously has a resilient skin with sufficient strength to support its own weight when secured to the backboard 14 by screws or bolts. Therefore, no steel inserts are required to distribute the weight as with foam pads.

In the preferred embodiment, the members 22 and 30 have a generally rectangular cross section with rounded corners, as shown in FIG. 8. The skin 50 forms an inner surface 60 that faces towards the edge of the backboard 14; an outer surface 62 that faces away from the edge of the backboard 14; a forward surface 64 that faces the same direction as the front of the backboard 14; and a rear surface 66 that faces the same direction as the rear of the backboard 14.

A rounded edge 70 is formed between the inner surface 60 and the forward surface 64. A rounded edge 70 is also formed between the inner surface 60 and the rear surface 66. The rounded edge 70 advantageously prevents players from hanging on the backboard pad 20 and thus damaging the pad 20 or tearing it from the backboard 14.

Figure 9:
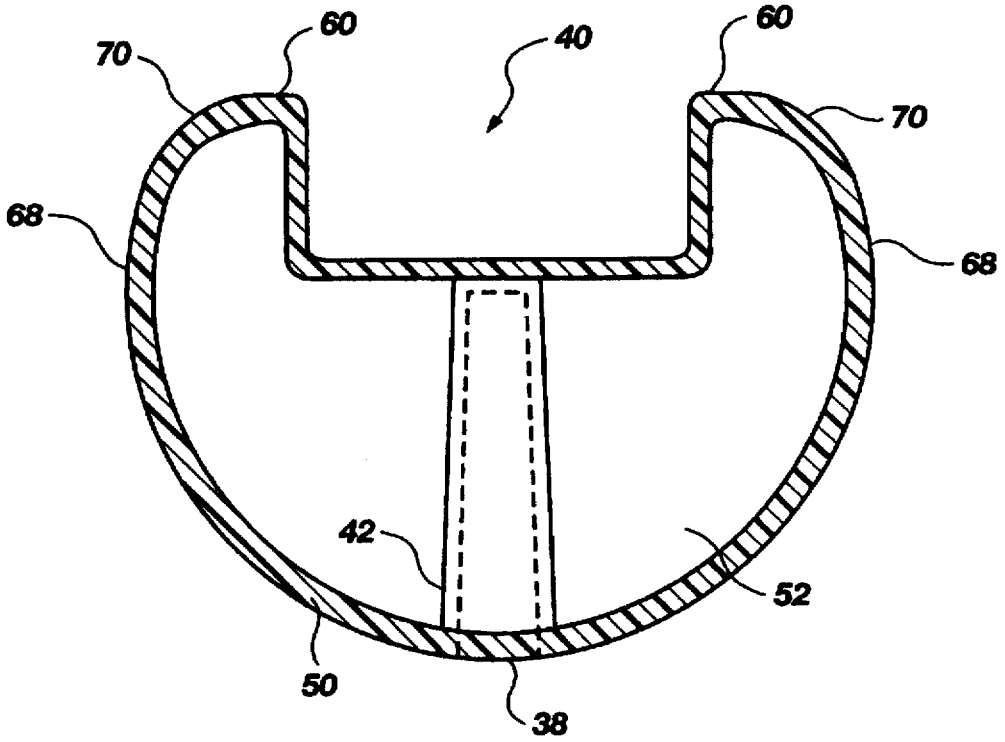
FIG. 9 is an elevational cross section view of an alternative embodiment of a backboard pad of the present invention.

Although the cross-sectional shape of the horizontal member 22 and vertical member 30 is preferably rectangular with rounded corners, as shown in FIG. 8, other shapes may be used. For example, the cross-sectional shape may be circular, as shown in FIG. 9. A rounded edge 70 may still be formed between the inner surface 60 and the remaining surface 68.

The inner surface 60 of the backboard pad 20 contacts the backboard 14 and is used to mount the pad 20 to the backboard 14. Screws or bolts (not shown) pass through the mounting holes 38 and secure the inner surface 60 to the edge of the backboard 14. The channel 40 is also formed in the inner surface 60 and mates with the edge of the backboard 14. Although a channel 40 is preferable used, the present invention may be accomplished without a channel, as shown in FIGS. 10–11.

In the preferred embodiment, the backboard pad 20 is advantageously made of a UV stable vinyl. Because the pad 20 is made of UV stable vinyl the pad 20 is able to withstand moisture, temperature changes, and sun exposure, and thus may be installed on outdoor goals 10. The vinyl may also be produced in various colors to correspond to team colors. Alternatively, the pad 20 may be made of any suitable elastomeric plastic, such as polyethylene.

The preferred embodiment of the backboard pad 20 of the present invention may be advantageously made by traditional, rotational molding techniques. A mold forms the outer shape of the pad 20. An appropriate amount of vinyl material, or other elastomeric plastic, is introduced into the mold through an opening. The mold, or more often a plurality of molds, is disposed on a rotating shaft. The mold is placed into an oven and rotated. The heat from the oven melts the vinyl material which coats the mold as it rotates. The mold is removed from the oven and opened to remove the pad 20. Rotational molding is easier and faster than molding foam with an integral skin. In addition, no inserts or coverings are required. The mold may be configured to produce pads of various sizes corresponding the standard sizes of backboards 14.

It is to be understood that the described embodiments of the invention are illustrative only, and that modifications thereof may occur to those skilled in the art. For example, the backboard pad 20 may have a filled interior 54, as shown in FIG. 11, where a greater cushion effect is desired. Accordingly, this invention is not to be regarded as limited to the embodiments disclosed, but is to be limited only as defined by the appended claims herein.

What is claimed is:

1. A basketball backboard device for protecting basketball players from the sharp edges and corners associated with the perimeter of a basketball backboard while maintaining the inherent vibration and rebound characteristics of the backboard when unmodified, said device comprising:

a basketball backboard having a lower edge; and an elongated and a hollow flexible tubular member having a channeled mounting surface extending into the tubular member and configured for attachment around the edge of the backboard, the tubular member having a resilient skin wall surrounding the hollow interior for protecting players from adverse contact with the lower edges of the backboard without substantially altering the vibration and rebound characteristics of the backboard.

2. The basketball backboard device of claim 1, further comprising mounting holes for securing the backboard device to the backboard.

3. The basketball backboard device of claim 1, wherein a radius is formed between the mounting surface and the remaining surface of the wall for preventing players from grasping and hanging from the device.

4. The basketball backboard device of claim 1, wherein the tubular member has a generally rectangular cross section with rounded corners and a channel.

5. The basketball backboard device of claim 1, wherein the tubular member has a generally cylindrical cross section with a channel.

6. The basketball backboard device of claim 1, wherein the resilient skin wall is vinyl.

7. The basketball backboard device of claim 6, wherein the vinyl is undegraded by ultraviolet radiation.

8. The basketball backboard device of claim 1, wherein the tubular member has a base portion for attaching around a portion of the lower edge of the backboard and at least one vertical portion coupled to the base portion for attaching around a portion of a side edge of the backboard.

9. The basketball backboard device of claim 1, further comprising at least one through hole extending through the tubular member for reinforcing the tubular member and draining moisture in the channel.

10. A basketball backboard device for protecting basketball players from the sharp edges and corners associated with the perimeter of a basketball backboard while maintaining the inherent vibration and rebound characteristics of the backboard when unmodified, said device comprising:

an elongated cushion member having a contact face with a U-shaped channel formed therein, the cushion member having opposing forward and rearward walls, a lower wall joining the forward and rearward walls, and a wall means for joining the forward and rearward walls to the channel, the cushion having a hollow interior surrounded by the walls; and a basketball backboard having a lower edge inserted in the channel for protecting players from adverse contact with the lower edges of the backboard without substantially altering the vibration and rebound characteristics of the backboard.

11. The basketball backboard device of claim 10, further comprising mounting holes for securing the backboard device to the backboard.

12. The basketball backboard device of claim 10, wherein the wall means includes a radius formed between the forward and rearward walls and the channel for preventing players from grasping and hanging from the device.

13. The basketball backboard device of claim 10, wherein the cushion member has a generally rectangular cross section with rounded corners and a channel.

14. The basketball backboard device of claim 10, wherein the wall is vinyl.

15. The basketball backboard device of claim 14, wherein the vinyl is undegraded by ultraviolet radiation.

16. The basketball backboard device of claim 10, wherein the cushion member has a base portion for attaching around a portion of the lower edge of the backboard and at least one vertical portion coupled to the base portion for attaching around a portion of a side edge of the backboard.

17. The basketball backboard device of claim 10, further comprising at least one through hole extending through the tubular member for reinforcing the tubular member and draining moisture in the channel.

* * * * *